United States Patent [19]

Tanaka et al.

[11] 4,426,558

[45] Jan. 17, 1984

[54] JACK HAVING AN INSULATING CONTACT OPERATOR

[75] Inventors: Masanori Tanaka, Osaka; Yukio Takihara, Kaizuka; Toru Masuda, Higashi-Osaka, all of Japan

[73] Assignee: Hosiden Electronics Co., Ltd., Japan

[21] Appl. No.: 272,978

[22] Filed: Jun. 11, 1981

[51] Int. Cl.[3] ..... H01R 33/54

[52] U.S. Cl. ..... 200/51.09

[58] Field of Search ..... 200/153 M, 51.09, 51.1, 200/51.11

[56] References Cited

U.S. PATENT DOCUMENTS

| | | | |
|---|---|---|---|
| 1,649,694 | 11/1927 | Hewitt | 200/51.1 |
| 2,641,661 | 6/1953 | Puerner et al. | 200/153 LA |
| 2,658,965 | 11/1953 | Smith | 200/51.1 |
| 2,666,829 | 1/1954 | Burkhard, Jr. et al. | 200/153 LA |
| 2,717,367 | 9/1955 | Puerner | 339/183 |
| 3,045,078 | 7/1962 | Frantz et al. | 200/51.1 |
| 3,435,163 | 3/1969 | Bailey et al. | 339/183 X |
| 3,573,409 | 4/1971 | Irwin et al. | 200/153 LA X |
| 3,676,625 | 7/1972 | Blatt | 200/153 LA |
| 3,812,310 | 5/1974 | Gasparaitis | 200/51.1 |
| 3,909,566 | 9/1975 | Morrison et al. | 200/51.1 X |
| 3,949,180 | 4/1976 | Ojima et al. | 200/51.1 |
| 4,029,924 | 6/1977 | Frank et al. | 200/307 |
| 4,324,958 | 4/1982 | Valleau | 200/16 F |

FOREIGN PATENT DOCUMENTS

| | | | |
|---|---|---|---|
| 929466 | 6/1955 | Fed. Rep. of Germany | 200/153 LA |
| 1093452 | 11/1960 | Fed. Rep. of Germany | 200/51.09 |

*Primary Examiner*—John W. Shepperd
*Assistant Examiner*—Renee S. Kidorf
*Attorney, Agent, or Firm*—Steele, Gould & Fried

[57] ABSTRACT

A jack having a jack case with an electrical contact switch adapted to be operated responsive to insertion and removal of a plug into and from the jack case along an insertion axis, the jack comprising: an insulating separator disposed with its longitudinal axis substantially parallel to the insertion axis, the separator having a projection at one end and the jack casing having a slot in one wall thereof for receiving the projection and enabling pivotal movement about the projection; and, the contact switch having a resilient contact piece which engages the other end of the separator and resiliently positions the separator within the housing, such that upon plug insertion, the plug will engage an intermediate portion of the separator, thereby pivoting the separator, the separator engaging and moving the contact piece to operate the contact switch.

7 Claims, 16 Drawing Figures

FIG. 8(a)
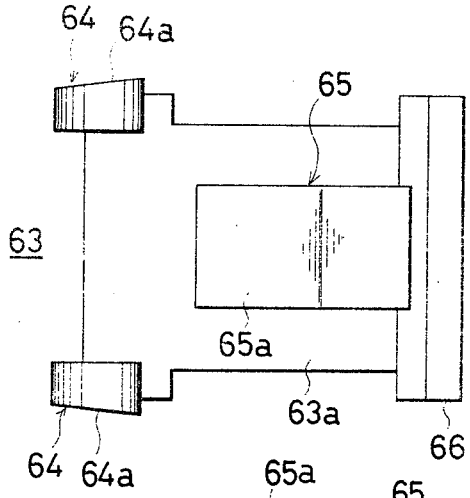
FIG. 8(b)
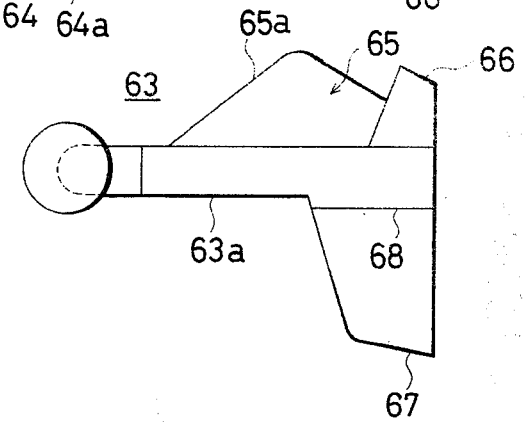
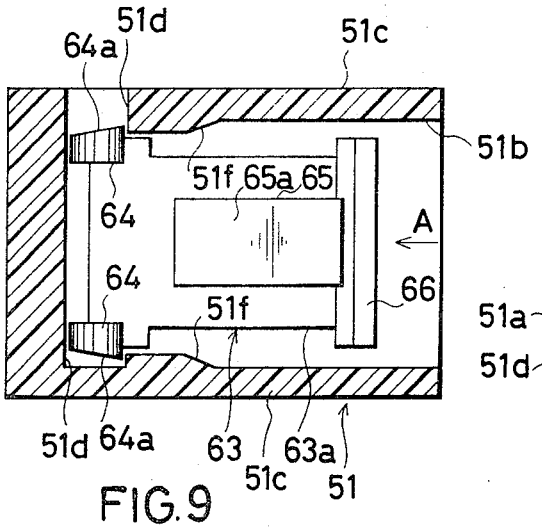
FIG.9
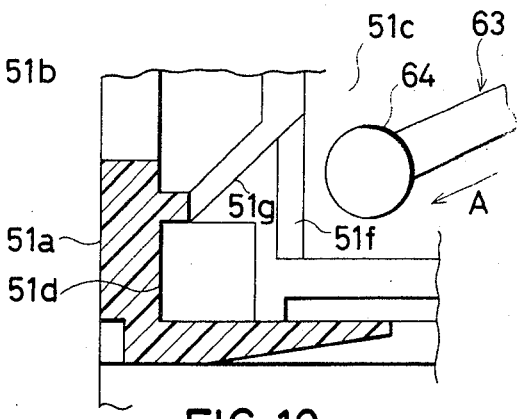
FIG.10

JACK HAVING AN INSULATING CONTACT OPERATOR

BACKGROUND OF THE INVENTION

There is known a jack in which one jack case houses so-called jack contact pieces adapted to come in contact with the conductor of a plug and to be maintained as contacted therewith. The jack case also houses contact switches of other systems independent from the jack contact pieces, these contact switches adapted to be closed/opened according to the insertion/removal of the plug. In such a jack, the movable-side contact pieces constituting the contact switches are generally pressed indirectly by the plug conductor through a separator made of an insulating material. These separators are conventionally secured directly to the movable-side contact pieces by means of press-insertion, fitting or welding. Therefore, certain portions of the movable-side contact pieces become inoperative, so that the resiliency of the contact pieces cannot be efficiently utilized.

In such a jack, the amount of displacement of the separator, at the time the plug is inserted, is relatively small and therefore the amount of stroke sufficient to open and close the contact switches cannot be provided. This presents a problem in that a switching operation of the contact switches is not securely performed.

SUMMARY OF THE INVENTION

It is a first object of the present invention to provide a jack in which a separator is formed independently from movable-side contact pieces constituting contact switches and the tips of the movable contact pieces are pressed by the free end of the separator so that the resiliency of the movable contact pieces is not damaged by the separator, whereby the resiliency of the movable-side contact pieces can be efficiently utilized.

It is a second object of the present invention to provide a jack in which the amount of displacement of the separator, at the time the plug is inserted, can be transmitted in a magnified manner to the movable-side contact pieces, so that a switching operation of the contact switches can be securely performed.

BRIEF DESCRIPTION OF THE DRAWINGS

FIGS. 1 to 5 illustrate a first embodiment of a jack in accordance with the present invention, in which:

FIG. 1 is a transverse section view of the jack with a plug P not inserted thereinto; FIG. 2 is a transverse section view of the jack with a plug P inserted thereinto; FIG. 3 is a disassembled perspective view; FIG. 4 is a section view taken along the line X–X' in FIG. 1; and FIG. 5 is a section view of the free end of a separator.

FIGS. 6 to 10 illustrate a second embodiment of a jack in accordance with the present invention, in which:

FIG. 6 is a section view of the jack with a plug 57 not inserted thereinto; FIG. 7 is a section view of the jack with the plug 57 inserted thereinto; FIG. 8(*a*) and (*b*) are a top view and a side view of a separator, respectively; FIG. 9 is a section view of the jack with the separator mounted in a jack case; and FIG. 10 is a view illustrating how to mount the separator in the jack case.

FIGS. 11 to 15 illustrate a third embodiment of a jack in accordance with the present invention, in which:

FIG. 11 is a side view; FIG. 12 is a front view; FIG. 13 is a back view; FIG. 14 is a section view taken along the line V–V' in FIG. 12; and FIG. 15 is a disassembled perspective view.

DETAILED DESCRIPTION OF THE INVENTION

Figure 1:
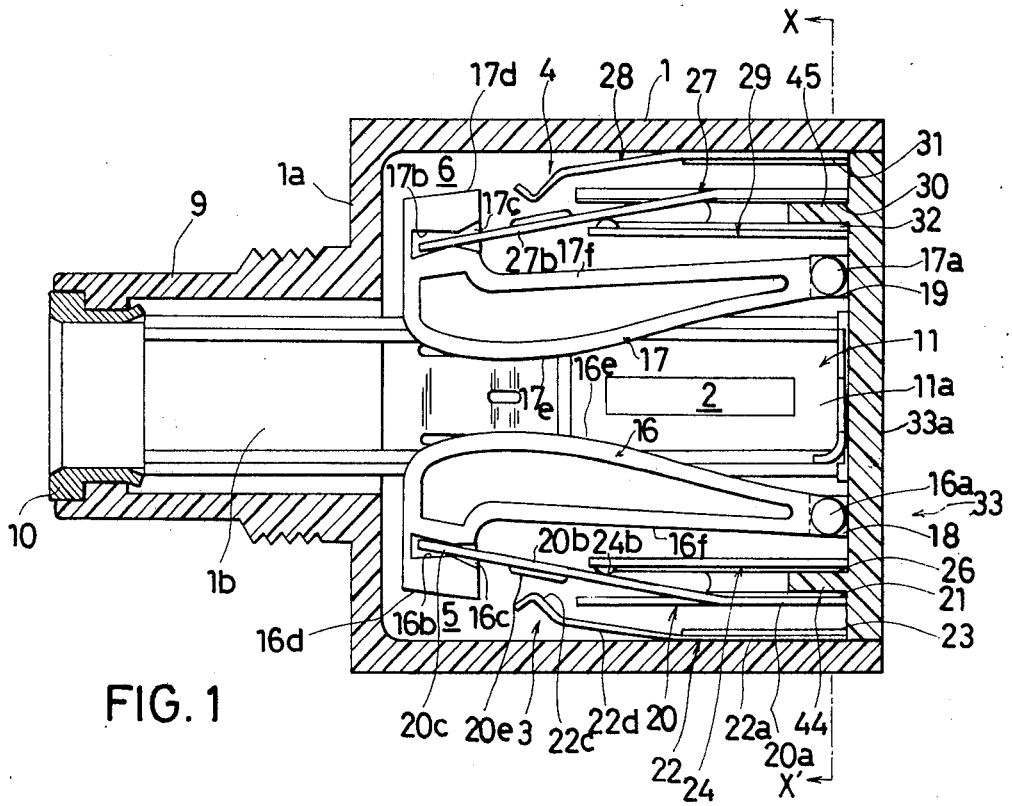

The description hereinafter will discuss the first embodiment of the present invention with reference to FIGS. 1 to 5.

A jack case 1 has an open rear end and is formed with plastic. The jack case 1 has at its inside center portion a plug insertion chamber 2 into which the conductor of a plug P is adapted to be inserted, and a pair of switch chambers 5 and 6 for respectively housing contact switches 3 and 4 respectively disposed at the both sides with respect to the plug insertion chamber 2. The plug insertion chamber 2 communicates with the respective switch chambers 5 and 6 through slit-shaped openings 7 and 8 defined in the jack case 1 running from the front end to the rear end thereof.

A cylindrical holder 9 forming a plug insertion port 1*b* projects from the front wall 1*a* of the jack case 1 and a metallic sleeve 10 is fitted into the inner periphery of the opening end of the cylindrical holder 9.

A jack contact piece 11 is adapted to come in contact with the channel-side conductor portion P1 of the plug P when it is inserted into the plug insertion chamber 2. The jack contact piece 11 has a rectangular main portion 11*a* of which both lateral edges are fittingly inserted into a housing groove 12 formed in the plug insertion chamber 2 at the upper portion thereof. The main portion 11*a* is provided with engagement projections 11*b* at the lateral edges thereof, by which the jack contact piece is secured to the jack case 1. A downwardly punched tongue 11*c* extends rearwardly and downwardly (FIG. 3) from the front end of the main portion 11*a*, and a terminal portion 11*d* is formed by turning the rear end of the main portion 11*a* at a right angle.

A jack contact piece 13 is adapted to come in contact with the grounding-side common conductor portion P3 of the plug P when it is inserted into the plug insertion chamber 2. Both lateral edges of its rectangular main portion 13*a* are press-inserted into a housing groove 14 formed in the lower portion of the plug insertion chamber 2. A tongue 13*b* extending from the front edge of the main portion 13*a* has curved tips 13*c* as shown, these tips 13*c* being located in the cylindrical holder 9. A terminal portion 13*d* projects from the rear end of the main portion 13*a* at a right angle thereto.

A jack contact piece 15 is adapted to come in contact with the other channel-side conductor portion P2 of the conductor of the plug P. Like the jack piece 13, both lateral edges of its rectangular main portion 15*a* are press-inserted into the housing groove 14. The main portion 15*a* has engagement projections 15*b*, by which the jack contact piece 15 is secured to the jack case 1.

An upwardly punched tongue 15*c* is extends from the front end of the main portion 15*a*. A terminal portion 15*d* projects from the rear end of the main portion 15*a* at a right angle thereto.

The jack contact pieces 13 and 15 are press-inserted into the same housing groove 14. However, while the jack contact piece 13 is disposed at the front side of the jack case 1, the jack contact piece 15 is disposed at the rear side of the jack case 1, so that the jack contact pieces 13 and 15 are separated from each other.

Respectively disposed in the slit-form openings 7 and 8 are separators 16 and 17 made of an insulating material having a substantially L shape section. These separators 16 and 17 respectively close the openings 7 and 8 for electrically insulating the plug insertion chamber 2 from the switch chambers 5 and 6, respectively. These separators 16 and 17 are located, at the intermediate portions thereof, adjacent the plug insertion port 1*b*.

The separators 16 and 17 have, at one ends thereof, projecting shaft portions 16*a* and 17*a*, which are respectively engaged with engagement holes 18 and 19 formed in the rear end of the jack case 1 such that the separators 16 and 17 are pivotally connected to the jack case 1 and are rotatable around the shaft portions 16*a* and 17*a*.

Figure 5:
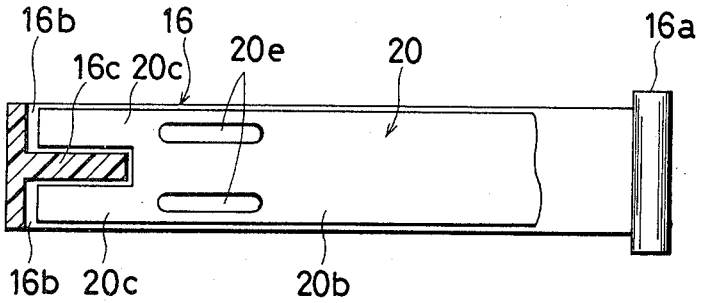
Figure 6:
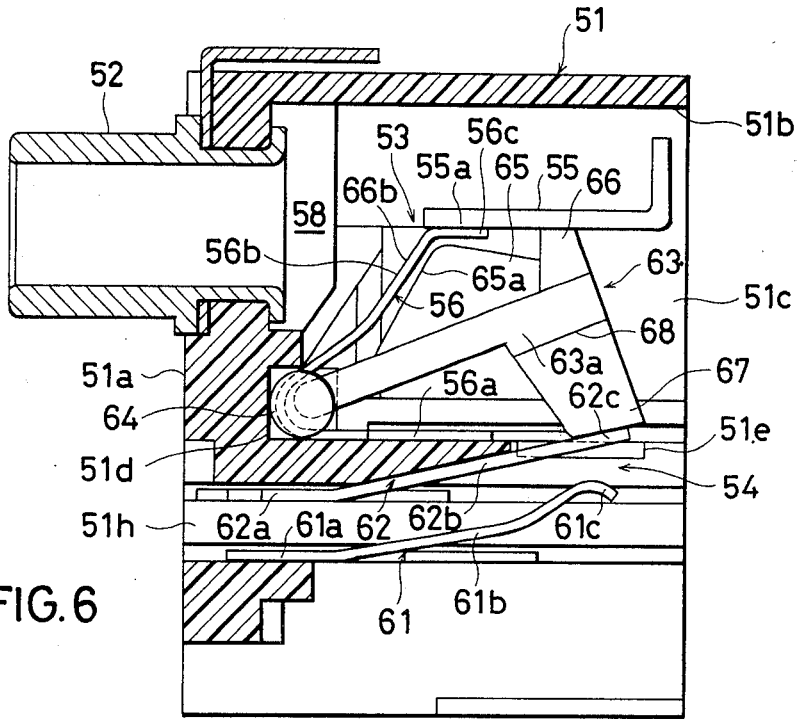

As shown in FIG. 5, the separators 16 and 17 have, at the free ends thereof, grooves 16*b* and 17*b* formed at the both sides with respect to partition walls 16*c* and 17*c*, such that the free ends of the separators 16 ans 17 have T shape sections in the longitudinal direction.

Figure 2:
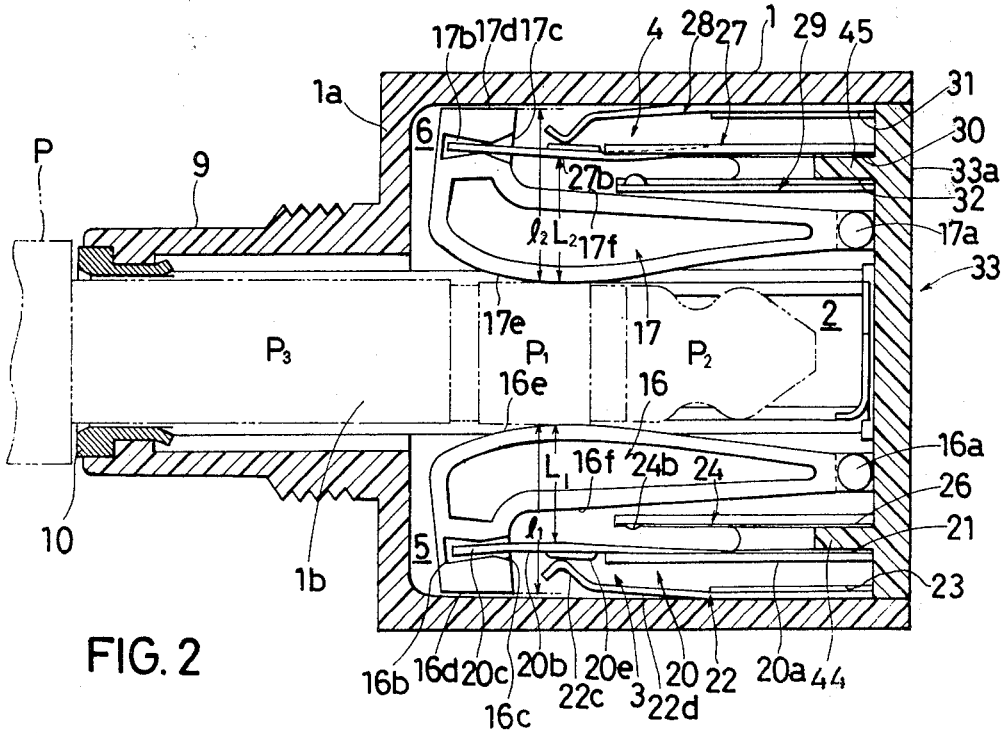
Figure 3:
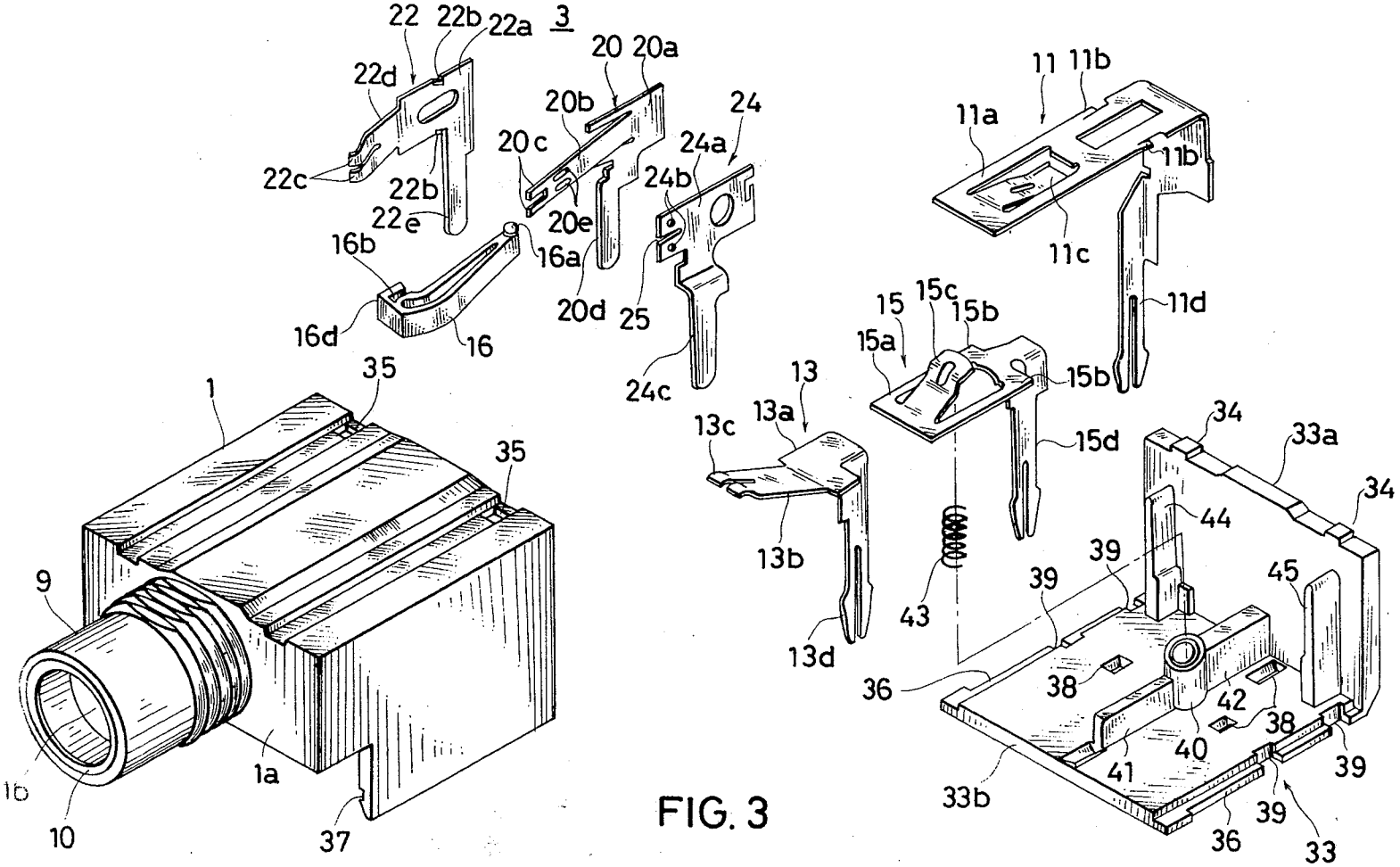
Figure 4:
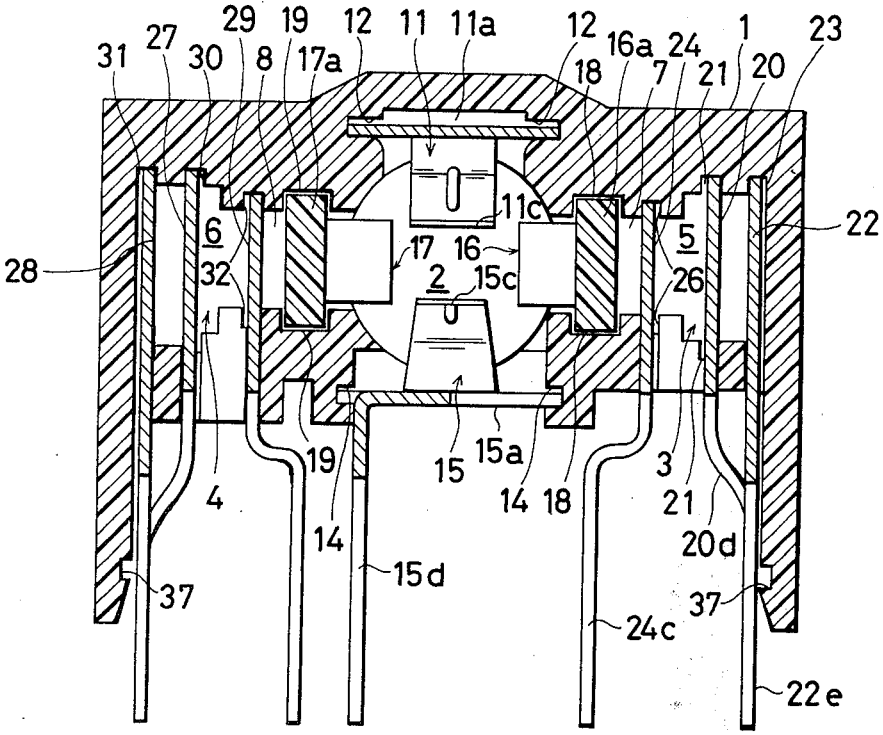

The separators 16 and 17 have, at the tips of the free ends thereof, contact faces 16*d* and 17*d*. As shown in FIG. 2, the distances l1 and l2 between these contact faces 16*d* & 17*d* and the back faces 16*e* & 17*e* of the separators 16 & 17, are set such that the contact faces 16*d* and 17*d* come in contact with the inner wall of the jack case 1 or face to the inner wall of the jack case 1 with a very small distance provided therebetween, when the plug P is inserted.

The maximum distances $L_1$ and $L_2$ between the back faces 16*e* & 17*e* of the separators 16 & 17 and tongue 20*b* & 27*b*, are set such that $L_1$ is smaller than $L_2$: namely, the projecting amounts of the separators 16 and 17 toward the plug insertion port 1*b* are different from each other.

In the switch chamber 5, a movable-side contact piece 20 constitutes the contact switch 3 and has a rectangular main portion 20*a* of which both lateral edges are press-inserted into housing grooves 21 formed in the switch chamber 5. A tongue 20*b* extends forwardly from the center of the main portion 20*a* which forms a predetermined angle together with the main portion 20*a*. The tongue 20*b* is branched, at the tip thereof, into two portions 20*c*, which are inserted into the grooves 16*b* in the separator 16. The main portion 20*a* has a terminal portion 20*d* formed integrally at the lower edge thereof.

Numeral 22 designates one fixed-side contact piece constituting the contact switch 3. The contact piece 22 has a rectangular main portion 22*a* of which both lateral edges are fittingly inserted into a housing groove 23. The contact piece 22 also has engagement projections 22*b* projecting from both lateral edges, by which the contact piece 22 is secured to the jack case 1. A tongue 22*d* extends from the front end of the main portion 22*a* and has two branched arcuate contacts 22*c* as shown.

When the plug P is not inserted, the contacts 22*c* are separated in a predetermined distance from the contacts 20*e* projecting from the tongue 20*b* of the movable-side contact piece 20, and when the plug P is inserted, the contacts 22*c* come in contact with the contacts 20*e*. An integrally formed terminal portion 22*e* projects from the lower edge of the rear end of the main portion 22*a*.

Numeral 24 designates other fixed-side contact piece constituting the contact switch 3. The contact piece 24 has a rectangular main portion 24*a*, in the frontal center of which a notch groove 25 is formed. A pair of contacts 24*b* project from both sides of notch groove 25. An integrally formed terminal portion 24*c* projects from the frontal lower edge of the main portion 24*a*. The main portion 24*a* is fittingly inserted, at both lateral edges thereof, into a housing groove 26. When the plug P is not inserted, the contacts 24*b* come in contact with the substantially center portion of the tongue 20*b* of the movable-side contact piece 20.

In the switch chamber 6, a contact switch 4 similar to the contact switch 3 is disposed. A movable-side contact piece 27 and fixed-side contact pieces 28 & 29, symetrical with respect to the movable-side contact piece 20 and the fixed-side contact pieces 22 & 24, are fittingly inserted into housing grooves 30, 31 and 32.

The jack case 1 is closed, at the rear opening thereof, by the vertical wall 33*a* of a resin cover 33 having an L shape section. The vertical wall 33*a* has at the top surface thereof engagement projections 34 which engage with engagement holes 35 formed in the top surface of the jack case 1. The base portion 33*b* of the cover 33 has, at both lateral edges thereof, linear projections 36 which are fittingly engaged with engagement grooves 37 formed in both lateral walls of the jack case 1. Thus, the cover 33 is secured to the jack case 1. The contact pieces and the shaft portions 16*a* and 17*a* of the separators 16 and 17 are positioned by the jack case 1 and the vertical wall 33*a* of the cover 33.

The base portion 33*b* has through-bores 38 and notches 39 through which the terminal portions of the contact pieces respectively pass. A cylindrical spring holder 40 is projectingly disposed at the center of the base portion 33*b*, and reinforcing ribs 41 and 42 are disposed at both sides of the spring holder 40.

A coil spring 43 is inserted in the spring holder 40, and the tongue 15*c* of the jack contact piece 15 is upwardly spring-loaded by the tip of the coil spring 43.

Ribs 44 and 46 integrally formed with the vertical wall 33*a* are disposed between the movable-side contact piece 20 and the fixed-side contact piece 24, and between the movable-side contact piece 27 and the fixed-side contact piece 29, respectively, thereby to maintain constant the distances between the movable-side contact piece 20 and the fixed-side contact piece 24, and between the movable-side contact piece 27 and the fixed-side contact piece 29.

According to such arrangement, the separators 16 and 17, made of an insulating material, can be formed independently from the movable-side contact pieces 20 and 27 constituting the contact swtiches 3 and 4, respectively. Moreover, the separators 16 and 17 come in contact with the movable-side contact pieces 20 and 27, respectively, only at the free ends of the separators 16 and 17 and the tips of the tongues 20*b* and 27*b* of the movable-side contact pieces 20 and 27. Accordingly, when the tongues 20*b* and 27*b* are pressed by the separators 16 and 17, the tongues 20*b* and 27*b* are wholly bent by the weight of the separators 16 and 17 applied to the tips of the tongues 20*b* and 27*b*, so that the resiliency of the tongues 20*b* and 27*b* can be efficiently utilized.

As discussed earlier, the separators 16 and 17 are each pivotally connected, at one end thereof, to the jack case 1, and those intermediate portions of the separators 16 and 17 with which the conductor of the plug P comes in contact, are located adjacent the plug insertion port 1*b*, and the free ends of the separators 16 and 17 press the tongues 20*b* and 27*b* of the movable contact pieces 20 and 27. Therefore, even though the amounts of displacement of the separators 16 and 17 passed and rotated by the conductor of the plug P are small at the intermediate portions of the separators 16 and 17, such displacement can be magnified at the free ends of the separators 16 and 17 and transmitted to the movable-side contact pieces 20 and 27, whereby the contact switches 3 and 4 can be securely switched.

In the embodiment discussed hereinbefore, the plug insertion chamber 2 is electrically insulated from the switch chambers 5 and 6 through the separators 16 and 17 made of an insulating material. Therefore, even if the contact switches 3 and 4 respectively disposed in the switch chambers 5 and 6 are positioned adjacent the conductor of the plug P inserted into the plug insertion chamber 2, sufficient insulation can be assured between the conductor of the plug P and the movable-side contact piece 20 & the fixed-side contact pieces 22 & 24 constituting the contact switch 3, and between the conductor of the plug P and the movable-side contact piece 27 & the fixed-side contact pieces 28 & 29 constituting the contact switch 4. Thus, the entire jack can be formed in a small size. Namely, in a conventional jack of this kind, spaces necessary for insulation should be disposed between the plug conductor and the contact switches, in order to provide predetermined insulation therebetween. However, according to the present invention, the separators 16 and 17 made of an insulating material are disposed in the slit-form openings 7 and 8 communicating the plug insertion chamber 2 with the respective switch chambers 5 and 6. Therefore, the distance between the contacts having different polarities where dielectric breakdown might occur, can be lengthened or made more circuitous as such breakdown seeks the shortest course around the separators 16 and 17. Thus, there can be manufactured a compact jack having more excellent insulating characteristics as compared with a conventional one.

Furthermore, according to the present invention, the contact faces **16*d* and 17*d* are disposed at the tips of the free ends of the separators 16 and 17. The respective distances $l_1$ and $l_2$ between the contact faces 16*d* & 17*d* and the back faces 16*e* & 17*e* of the separators 16 & 17 are set such that the contact faces 16*d* and 17*d* come in contact with the inner wall of the jack case 1 or face to the inner wall of the jack case 1 with a very small distance provided therebetween, when the plug P is being inserted, as shown in FIG. 2. Therefore, even if an external force to longitudinally move the plug P is exerted to the plug P when the plug P is inserted or is being inserted, there is no possibility of the movable-side contact pieces 20 and 27 being excessively bent, so that the durability of the movable-side contact pieces 20 and 27** and subsequently the jack itself can be enhanced.

Moreover, the maximum distances $L_1$ and $L_2$ between the back faces **16*e* & 17*e* of the separators 16 & 17 and the tongues 20*b* & 27*b* are different from each other; for example, $L_1$ is smaller than $L_2$. Therefore, when the plug P is inserted, the separator 17 starts rotating earlier than the separator 16, so that the switching operation of the contact switch 4 is performed prior to the switching operation of the contact switch 3. Namely, since the contact switches 3 and 4** are different in switching timing from each other, the scope of application of the circuit design can be expanded. it is to be noted that the distances $L_1$ and $L_2$ can be made the same, if it is not necessary to stagger the respective changeover timings.

The description hereinafter will discuss a second embodiment of the present invention with reference to FIGS. 6 to 10.

A jack case 51 made of an insulating material has an open back and is provided at the front wall **51*a* thereof with a plug insertion sleeve 52. The jack case 51 houses first and second contact switches 53 and 54. The first contact switch 53 comprises a fixed contact piece 55 and a movable contact piece 56, and is of the normally closed type. The fixed contact piece 55 is pressingly inserted from the back opening 51*b* of the jack case 51 and has at the center portion thereof a notch (not shown) for avoiding a plug 57 to be inserted through the plug insertion sleeve 52**.

The movable contact piece 56 is a so-called jack contact piece adapted to come in contact with the conductor of the plug 57 and to be maintained as contacted therewith. The contact piece 56 has a curved tongue **56*b*, projecting from the front edge of a rectangular plate 56*a* which is pressingly inserted into and secured to the jack case 51 from the back opening 51*b*. The tongue 56*b* has at the tip thereof a contact 56*c*, which comes in contact with the contact 55*a* of the fixed contact piece 55. The tongue 56*b* is positioned in the course of a plug insertion path 58**.

The second contact switch 54 is a contact switch of a system independent from the movable contact piece 56. The second contact switch 54 comprises a fixed contact piece 61 and a movable contact piece 62, and is of the normally open type. The movable contact piece 62 is disposed adjacent and under the movable contact piece 56.

The contact pieces 61 and 62 respectively have tongues **61*b* and 62*b* projecting from the rear ends of rectangular plate portions 61*a* and 62*a*, which are pressingly inserted into and secured to the jack case 51 from a frontal opening 51*h*. The tips of the tongue 61*b* and 62*b* are formed as contacts 61*c* and 62*c***.

A separator 63 made of an insulating material is disposed between the movable contact pieces 56 and 62 and between the tongue pieces **65*b* and 62*b*. This separator 63 is integrally formed with a synthetic resin or the like. The separator 63 has integrally formed cylindrical engagement portions 64 having tapering portions 64*a* which are disposed at both sides of one end of a rectangular plate portion 63*a*, as shown in FIG. 8** (*a*) and (*b*). As shown in FIG. 9, these engagement portions 64 are engaged with engagement bores **51*d* formed in the both lateral walls 51*c* of the jack case 51. By such engagement, the separator 63 is held rotatably in such range as to come in contact with the movable contact pieces 56 and 62 of the first and second contact switches 53 and 54**.

The separator 63 also has a support projection 65 having a receiving face **65*a* adapted to continuously come in contact with the tongue 56*b* of the movable contact piece 56 along its whole length when the plug 57 is inserted, the support projection 65 being integrally formed with the plate portion 63*a* at its side of the first contact switch 53**.

The separator 63 also has a projection 66 to come in contact with the lower surface of the fixed contact piece 55, thereby to restrict the position of the separator 63 when it is upwardly reset.

The separator 63 also has, at the side of the second contact switch 54 of the plate portion **63*a*, a projection 67 to come in contact with the upper surface of the movable contact piece 62 of the second contact switch 54, thereby to downwardly press the movable contact piece 62. Stoppers 68 integrally disposed at the both sides of the projection 67, come in contact with shelves 51*e* projected from the both lateral walls 51*c* of the jack case 51, thereby to restrict the amount of stroke of the separator 63 in the direction toward the second contact switch 54**.

The separator 63 is mounted to the jack case 51 in such a manner that, while the engagement portions 64 of the separator 63 are slid in the lateral walls 51*c* of the jack case 51, the separator 63 is pressingly inserted from the rear opening 51*b* of the jack case 51 in the direction of the arrow A such that the engagement portions 64 are engaged with the engagement bores 51*d*. In order to facilitate such pressing-insertion of the separator 63, those lateral walls 51*c* of the jack case 51 with which the engagement portions 64 are slidingly contacted, have inclined faces 51*f* and guide walls 51*g* for guiding the engagement portions 64 into the engagement bores 51*d*, as shown in FIG. 10.

Where the separator 63 is inserted into the jack case 51, one end of the separator 63 is supported by the front end side of the jack case 51 and the support projection 65 formed at the intermediate position of the separator 63 is located in the plug insertion path 58 such that the free end or the projection 67 of the separator 63 presses the tip of the movable contact piece 62.

Figure 7:
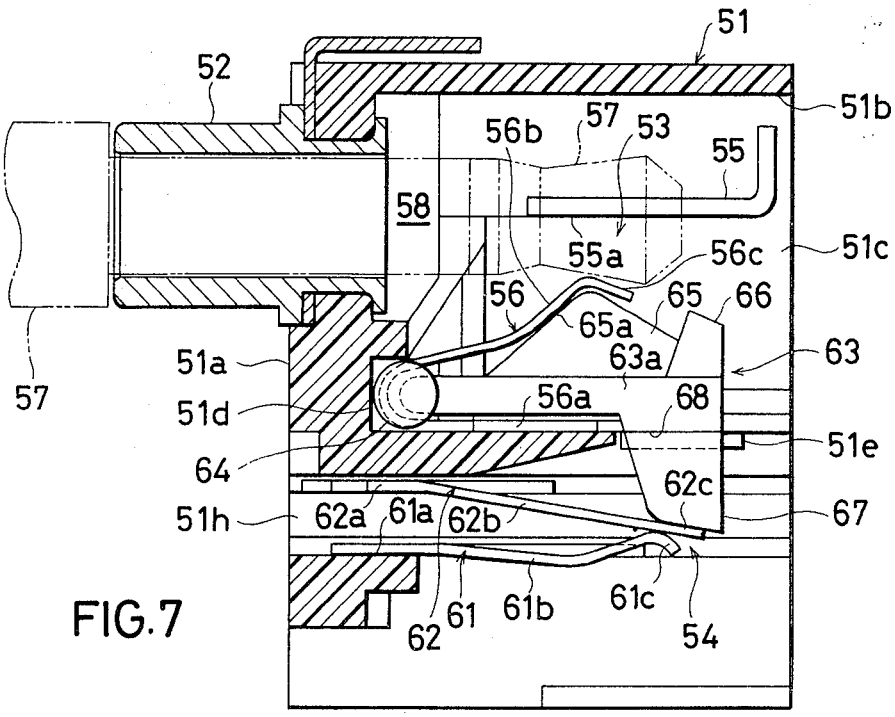
Figure 11:
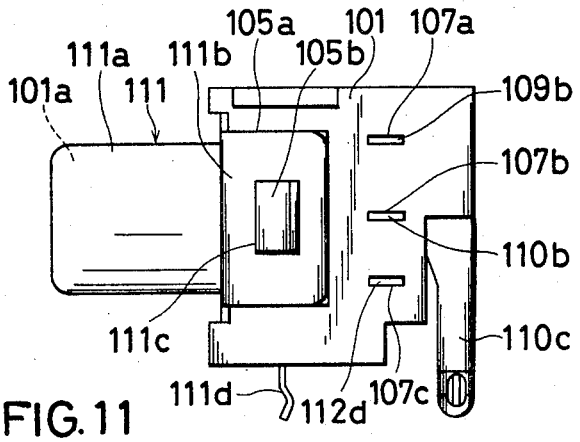
Figure 12:
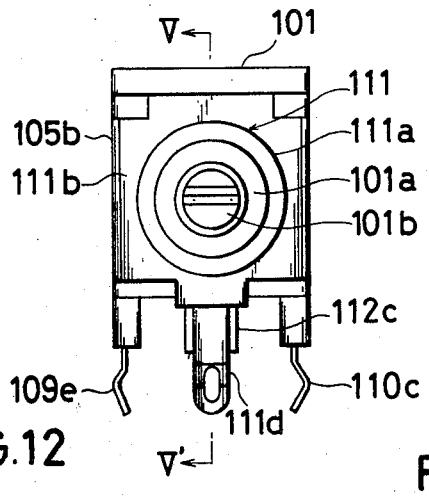
Figure 13:
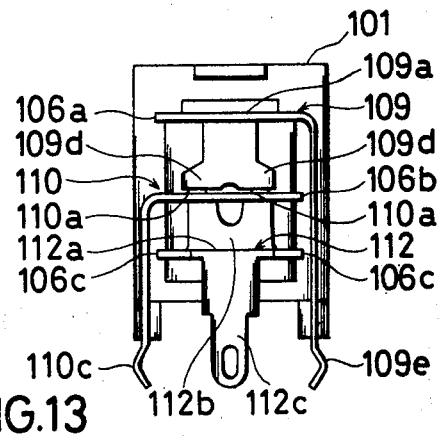
Figure 14:
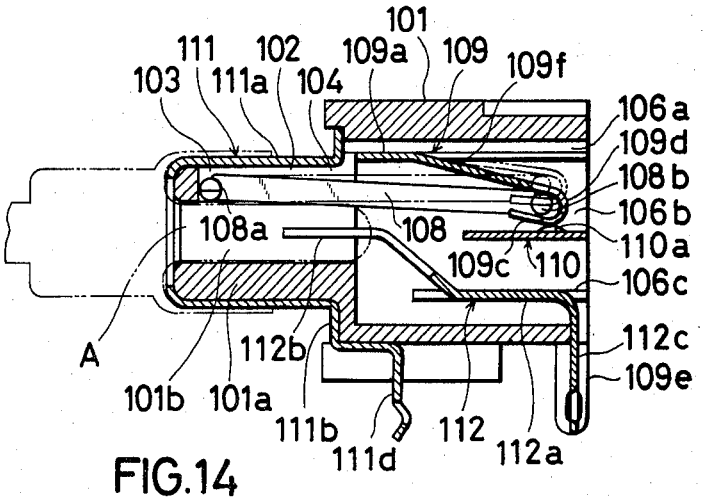
Figure 15:
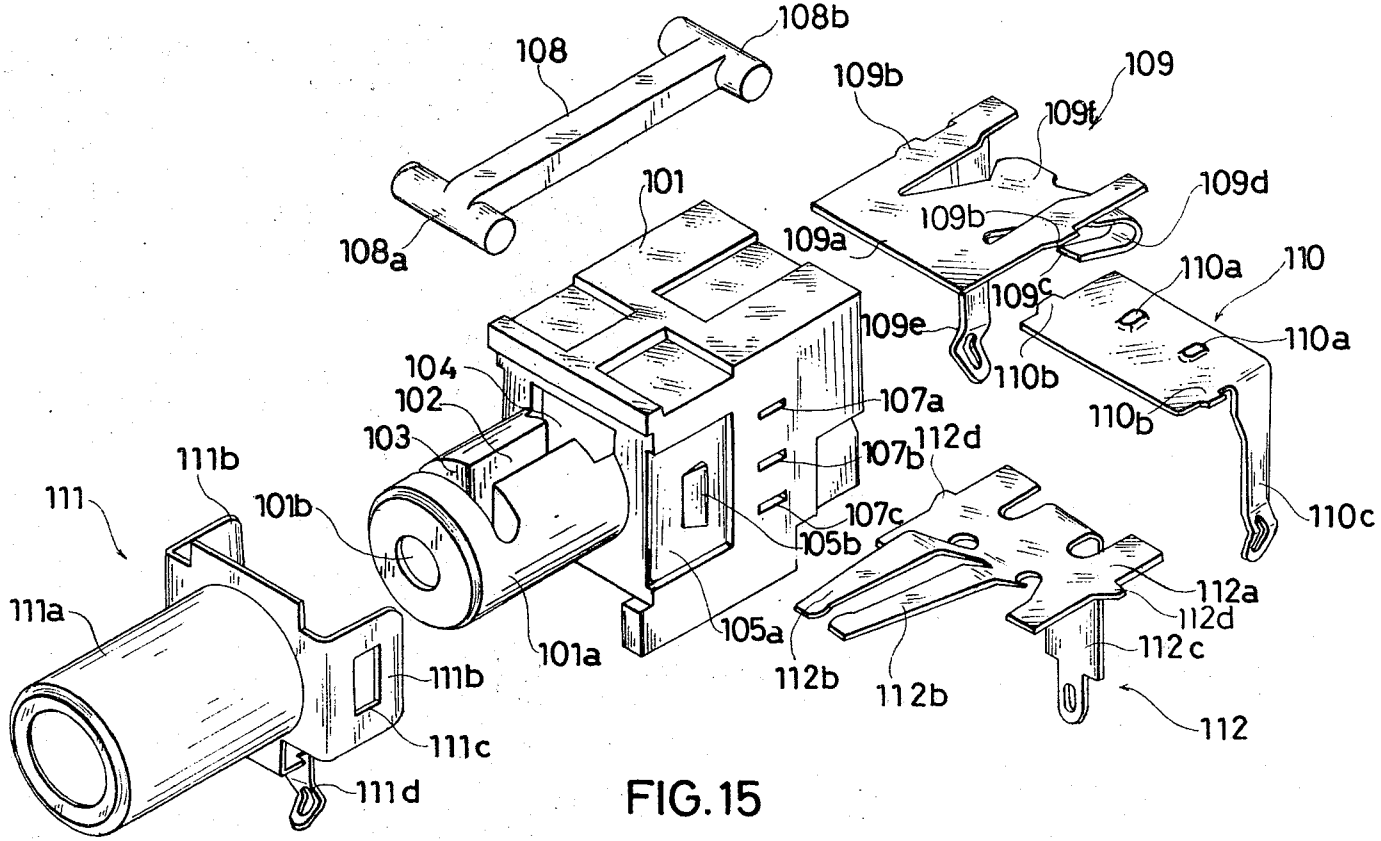

According to such construction, when the plug 57 is inserted into the plug insertion path 58 as shown in FIG. 7, the movable contact piece 56 of the first contact switch 53 is pressed and downwardly bent by the tip of the plug 57, so that the contact 56*c* of the movable contact piece 56 is separated from the contacts 55*a* of the fixed contact piece 55, whereby the first contact switch 53 is switched to the off-state. The separator 63 is pressed and downwardly rotated by the movable contact piece 56, so that the projection 67 extending from the separator 63 pushes down on the movable contact piece 62 of the second contact switch 54. Then, the contact 62*c* of the movable contact piece 62 comes in contact with the contact 61*c* of the fixed contact piece 61, so that the second contact switch 54 is switched to the on-state.

The separator 63 is formed independently from the movable contact piece 62 constituting the second contact switch 54, and the tip or the contact 62*c* of the movable contact piece 62 is adapted to be pressed by the free end or the projection 67 of the separator 63. Accordingly, the tongue 62*b* of the movable contact piece 62 is bent along its whole length by the weight applied to the tip of the tongue 62*b*, so that the resiliency of the tongue 62*b* can be efficiently utilized.

Moreover, the separator 63 is supported at one end thereof by the jack case 51, and the support projection 65 formed at the intermediate position of the separator 63 is located in the plug insertion path 58 such that the free end or the projection 67 of the separator 63 presses the tongue 62*b* of the movable contact piece 62. Therefore, even if the amount of displacement of the separator 63 to be pressed and rotated by the plug 57 is small at the intermediate portion of the separator 63, such amount of displacement is magnified at the free end of the separator 63 and is transmitted to the movable-side contact piece 62, so that the switching operation of the contact switch 54 can be securely made.

In this embodiment discussed hereinbefore, the separator 63 has, at the side of the first contact switch 53 of the plate portion 63*a*, the support projection 65 provided with a receiving surface 65*a*, and the movable contact 56 successively comes in contact with the whole length of the receiving surface 65*a* of the support projection 65, so as to support the movable contact piece 56 at the back side thereof. Therefore, even if the plug 57 is longitudinally moved, the tongue 56*b* is not bent over a predetermined angle and is plastically deformed, so that there is no possibility of the tongue 56*b* being defectively contacted with the fixed contact piece 55.

As mentioned earlier, the separator 63 has, at the side of the second contact switch 54 of the plate portion 63*a*, the stoppers 68 to come in contact with the shelves 51*e* projected from the lateral walls 51*c* of the jack case 51, thereby to restrict the amount of stroke of the separator 63 in the direction toward the second contact switch 54. Therefore, even if the plug 57 is longitudinally moved, a pressing force larger than a predetermined one is not applied to the movable contact piece 62 and the fixed contact piece 61 of the second contact switch 54, and the movable contact piece 62 and the fixed contact piece 61 are plastically deformed, so that there is no possibility of defective contact.

When the plug 57 is inserted, the second contact switch 54 is pressed and turned ON by the separator 63 pressingly rotated by the movable contact piece 56 of the first contact switch 53. Namely, the second contact switch 54 is turned ON after the first contact switch 53 has been turned OFF. Therefore, there is no possibility of the first and second contact switches 53 and 54 performing the switching operation at the same time, or of the second contact switch 54 being switched prior to the first contact switch 53. Accordingly, it is possible to stagger the changeover timings of the first and second contact switches 53 and 53 by a suitable interval. Thus, the application scope of the circuit design can be expanded.

Further, the engagement portions 64 of the separator 63 are provided with the tapering portions 64*a*, and those lateral walls 51*c* of the jack case 51 with which the engagement portions 64 are slidingly engaged, are provided with the inclined surfaces 51*f* and the guide walls 51*g* for guiding the engagement portions 64 into the engagement bores 51*d*. Such arrangement facilitates the insertion of the separator 63 into the jack case 51 and therefore improves the assembling efficiency.

In the second embodiment discussed hereinbefore, the movable contact piece 56 of the first contact switch 53 is designed so as to successively come in contact with the receiving surface 65*a* of the support projection 65 of the separator 63. However, the movable contact piece 56 can be designed so as to come in contact only with the top of the support projection 65.

The description hereinafter will discuss a third embodiment of the present invention, with reference to FIGS. 11 to 15.

A jack case 101 of the box shape has an open back. A cylindrical holder 101*a* into which a plug is adapted to be inserted, projects from the front wall of the jack case 101. A groove 102 aligned along the plug insertion direction is formed in a portion, for example an upper portion, of the periphery of the central hole or a plug insertion hole 101*b* of the cylindrical holder 101*a*, the groove 102 communicating with the inside of the jack case 101. In other words, the groove 102 is a longitudinal slit formed in the peripheral wall of the plug insertion holder 101*a* and extending from near to the open end of the plug insertion hole 101*b* to the inner end thereof.

A transverse groove 103 for receiving a pivoting shaft member is formed in the plug insertion holder 101*a* at the upper portion of the tip thereof with an open top. The groove 103 communicates with the front end of the groove 102. A transverse communicating hole 104 is formed in the plug holder 101*a* at the upper portion of the base thereof and communicates with the rear end of the groove 102. The groove 103 and the hole 104 will be discussed later.

The jack case 101 is provided at both lateral walls thereof with engagement concave portions 105*a* and engagement projections 105*b* for attaching a cover, to be discussed later.

The jack case 101 is provided in the opposite portions of both inner lateral walls thereof with longitudinal housing grooves 106*a*, 106*b* and 106*c* for housing contact pieces to be discussed later, these housing grooves being respectively formed in the upper, intermediate and lower portions of the respective walls and opening on the back side of the jack case 101. These housing grooves 106*a*, 106*b* and 106*c* communicates with engagement holes 107*a*, 107*b* and 107*c* formed in the jack case 101 at the intermediate portion thereof.

The groove 102 houses a rod-shape separator 108 made of an insulating material extending from the open end of the plug insertion hole 101*b* into the jack case 101. The separator 108 is pivoted at one end thereof by the open end of the plug insertion hole 101*b*. At the inner end of the plug insertion hole 101*b*, the intermediate portion of the separator 108 is brought close to the axis of the plug insertion hole 101*b* rather than the periphery of the plug insertion hole 101*b*, the separator 108 being housed in a manner rotatable in the radial direction of the plug insertion hole 101*b*.

The separator 108 formed in a unitary construction from an insulating material such as a synthetic resin, is provided with a pivotal portion 108*a* integrally formed with one end of the separator 108 in the T shape, and such pivotal portion 108*a* is fittingly inserted into the groove 103 formed in the open end of the plug insertion hole 101*b*. The separator 108 is also provided with a contact operating portion 108*b* integrally formed with the other end of the separator 108 in the T shape, and such portion 108*b* is inserted into the substantially intermediate portion of the jack case 101 through the communicating hole 104. The separator 108 is housed in the plug insertion hole 101*b* in a direction substantially parallel with the plug insertion direction, with the intermediate portion of the separator 108 brought close to the axe of the plug insertion hole 101*b* at the inner end thereof rather than the periphery of the plug insertion hole 101*b* in other words the separator 108 is inclined slightly toward the axis of the plug insertion hole 101*b*.

A movable contact piece 109 has a rectangular main portion 109*a*, of which both lateral edges are fittingly inserted into the uppermost housing groove 106*a*. Engagement projections 109*b* projected from the lateral edges of the main portion 109*a* are engaged with the engagement holes 107*a*. Thus, the movable contact piece 109 is secured to the jack case 101.

The movable contact piece 109 has a tongue 109*f* extending rearwardly and downwardly from the center portion of the rectangular main portion 109*a*. The tongue 109*f* has a pair of contacts 109*c* formed by turning the two branched tips of the tongue 109*f* in the U shape. The contact operating portion 108*b* of the separator 108 is fittingly inserted into the turned portions 109*d* of the contacts 109*c*. The contacts 109*c* of the movable contact piece 109 come in contact with a pair of fixed contacts 110*a* projected upwardly from the rear portion of a rectangular fixed contact piece 110 which is fittingly inserted into the intermediate housing groove 106*b*; namely the contacts 109*c* are held as normally closed.

The fixed contact piece 110 is provided at both lateral edges thereof with engagement projections 110*b* which engage with the engagement holes 107*b* of the jack case 101.

The conductor terminals of the contacts 109 and 110 are generally designated by numerals 109*e* and 110*c*, respectively.

A cover 111 for covering the cylindrical holder 101*a* has a cylindrical portion 111*a* adapted to come in contact with a plug grounding piece, and a mounting portion 111*b* projected from the rear end of the cylindrical portion 111*a* in the ⊔ shape, the mounting portion 111*b* being mounted to the jack case 101. Namely, the mounting portion 111*b* is fitted to the engagement concave portions 105*a* of the jack case 101, with engagement holes 111*c* in the both lateral sides of the mounting portion 111*b* engaged with the engagement projections 105*b* of the jack case 101. The groove 102 is closed by covering the cylindrical holder 101*a* with the cylindrical portion 111*a*, and the pivotal portion 108*a* formed at one end of the separator 108 is held in the pivotal groove 103, so that said one end of the separator 108 is pivotally secured to the jack case 101.

When a pin plug A is inserted into or removed from the plug insertion hole 101*b* of the cylindrical holder 101*a*, the intermediate portion of the separator 108 is pushed forward or backward while rotated by the insertion end of the pin plug A in the vertical or radial direction. By such rotation, the contact/separation operation of the movable contact piece 109 located at the side of said other end of the separator 108 with/from the fixed contact piece 110 is performed in a stroke magnified, for example twice, as compared with that at the intermediate portion of the separator 108.

The conductor terminal of the cover 111 is generally designated by numeral 111*d*.

A jack contact piece 112 adapted to come in contact with the pin plug A has a rectangular base portion 112*a*, contacts 112*b* which are projected from the front edge of the base portion 112*a* and inserted into the plug insertion hole 101*b*, and a conductor terminal 112*c* projected from the rear end of the base portion 112*a*. The lateral edges of the base portion 112*a* are fittingly inserted into the lowermost housing grooves 106*c*, and engagement projections 112 extending from the lateral edges of the base portion 112*a* are engaged with the engagement holes 107*c*. Thus, the jack contact piece 112 is secured to the jack case 101.

According to such arrangement, the intermediate portion of the separator 108 located in the plug insertion hole 101*b* of the jack case 101 is pressed by the pin plug A and is subsequently rotated counterclockwise with said one end or the pivotal portion 108*a* of the separator 108 acting as a fulcrum. Then, the turned portions 109*d* of the movable contact piece 109 into which the free end or the contact operating portion 108*b* of the separator 108 is inserted, are pushed up, so that the contacts 109*c* of the movable contact piece 109 are separated from the fixed contacts 110*a* of the fixed contact piece 110, whereby the off-state is provided.

As thus described hereinbefore, the intermediate portion of the separator 108 is pressed by the pin plug A and the movable contact piece 109 is pressingly biased by the free end of the separator 108. Therefore, even if the amount of displacement of the separator 108 pressed and rotated by the pin plug A is small at the intermediate portion of the separator 108, such amount of displacement is transmitted to the movable contact piece 109 while magnified at the free end of the separator 108.

Thus, the contact/separation operation of the movable contact piece 109 with/from the fixed contact piece 110 can be securely performed. Such arrangement is very convenient particularly for a jack where the plug conductor portion is of a small diameter and the insertion amount of the plug into the jack case is small, such as the pin jack shown and described in the third embodiment.

Moreover, since the separator 108 made of an insulating material is independently formed from the movable contact piece 109 and the tips of the movable contact piece 109 are pressingly operated by the free end of the separator 108, the tongue 109*f* of the movable contact piece 109 is bent along its whole length by the weight applied to the tips of the tongue 109*f*, so that the resiliency of the tongue 109*f* can be effectively utilized.

It is apparent that various modifications and changes may be made without departing from the spirit and principle of the present invention.

For example, while in the third embodiment the contacts 109*c* of the movable contact piece 109 are constructed in the two-branched structure, such contact portion is not necessarily required to be branched into two portions.

The separator is not limited to a linear one, but can be slightly curved.

What is claimed is:

1. A jack having a jack case with an electrical contact switch adapted to be operated responsive to insertion and removal of at plug, having a conductor portion, into and from the jack case, along an insertion axis, the jack comprising:

a jack contact piece adapted to be engaged by the conductor portion of the plug and to remain in contact therewith until plug removal;

an insulating separator, having a receiving surface for supporting the jack contact piece at its back surface, disposed with its longitudinal axis substantially parallel to the insertion axis, the separator having a projection at one end and the jack case having a slot in one wall thereof for receiving the projection and enabling pivotal movement about the projection, the separator further having a stopper for engaging the jack case to restrict the pivotal movement; and, the contact switch having a resilient contact piece which engages the other end of the separator and resiliently positions the separator within the housing, such that upon plug insertion, the plug will indirectly engage an intermediate portion of the separator through the jack contact piece, and thereby pivot the separator, the separator engaging and pivoting the resilient contact piece to operate the electrical contact switch.

2. The jack as set forth in claim 1, wherein the stopper portion projects laterally from the contact piece engaging end thereof, the stopper portion forming an abutment surface which restricts the pivotal movement of the separator during plug insertion.

3. The jack as set forth in claim 1, wherein the jack case comprising a plug insertion chamber for receiving the plug and a contact switch chamber communicating with said plug insertion chamber through an opening, said separator being disposed in said opening to electrically insulate said plug insertion chamber from said switch chamber.

4. The jack as set forth in claim 3, wherein the jack case comprises two of said switch chambers, disposed on two sides of said plug insertion chamber, and further comprising two of said jack contact pieces and two of said separators, one separator disposed in each of the openings through which said switch chambers communicate with said plug insertion chamber and engageable by one of the jack contact pieces.

5. The jack as set forth in claim 4, wherein the separators comprise portions projecting toward the plug insertion chamber which are different from one another to thereby enable sequential indirect engagement of the separators by the plug through the jack contact pieces.

6. The jack as set forth in claim 1, wherein the jack case comprises an annular projecting portion defining a plug insertion port, the annular portion having a groove formed therein, substantially parallel to the insertion axis, the groove communicating with the interior of said jack case and having a perpendicular slot at the other end for receiving the projection of the separator to enable the pivotal movement of the separator in said groove.

7. A jack having a jack case with an electrical contact switch adapted to be operated responsive to insertion and removal of a plug into and from the jack case, along an insertion axis, the jack comprising:

an insulating separator disposed with its longitudinal axis substantially parallel to the insertion axis, the separator having a projection at one end;

an annular portion projecting from the jack case and defining a plug insertion port, the annular portion having a groove formed therein, substantially parallel to the insertion axis, the groove communicating with the interior of the jack case and having a perpendicular slot at the other end for receiving the projection of the separator to enable the pivotal movement of the separator in the groove; and, the contact switch having a resilient contact piece which engages the other end of the separator and resiliently positions the separator within the housing, such that upon plug insertion, the plug will indirectly engage an intermediate portion of the separator, and thereby pivot the separator, the separator engaging and pivoting the contact piece to operate the electrical contact switch.

* * * * *